US006169276B1

(12) United States Patent
Meyer

(10) Patent No.: US 6,169,276 B1
(45) Date of Patent: Jan. 2, 2001

(54) ELECTRICAL HEATING APPARATUS

(75) Inventor: Helmut Meyer, Monchengladbach (DE)

(73) Assignee: Polytetra Draack + Meyer GmbH (DE)

( * ) Notice: Under 35 U.S.C. 154(b), the term of this patent shall be extended for 0 days.

(21) Appl. No.: 09/379,672

(22) Filed: Aug. 24, 1999

(30) Foreign Application Priority Data

Sep. 1, 1998 (DE) ..... 198 39 651

(51) Int. Cl.[7] ..... H05B 3/10
(52) U.S. Cl. ..... 219/553; 338/238
(58) Field of Search ..... 219/553, 540, 219/542, 544, 548, 530; 338/256, 257, 245, 248, 230; 29/611, 613

(56) References Cited

U.S. PATENT DOCUMENTS 4,001,760 * 1/1977 Howie et al. ..... 338/238
4,564,745 * 1/1986 Deschenes ..... 219/213
4,876,440 * 10/1989 Kamath et al. ..... 219/548
5,060,287 * 10/1991 Van Egmond ..... 392/301

* cited by examiner

*Primary Examiner*—Teresa Walberg
*Assistant Examiner*—Quang Van
(74) *Attorney, Agent, or Firm*—Mason, Kolehmainen, Rathburn & Wyss

(57) ABSTRACT

In an electrical heating apparatus having at least one heating body with a chemically substantially resistant sheathing surrounding same, the sheathing comprises at least two-layer co-extruded material. The material comprises an inner layer which in the position of use is towards the heating body and which comprises a material that is a good conductor of heat. Arranged on the outside of the inner layer is an outer layer of chemically substantially resistant and electrically non-conductive material. The inner layer and the outer layer are homogeneously fused together without air inclusions.

10 Claims, 1 Drawing Sheet

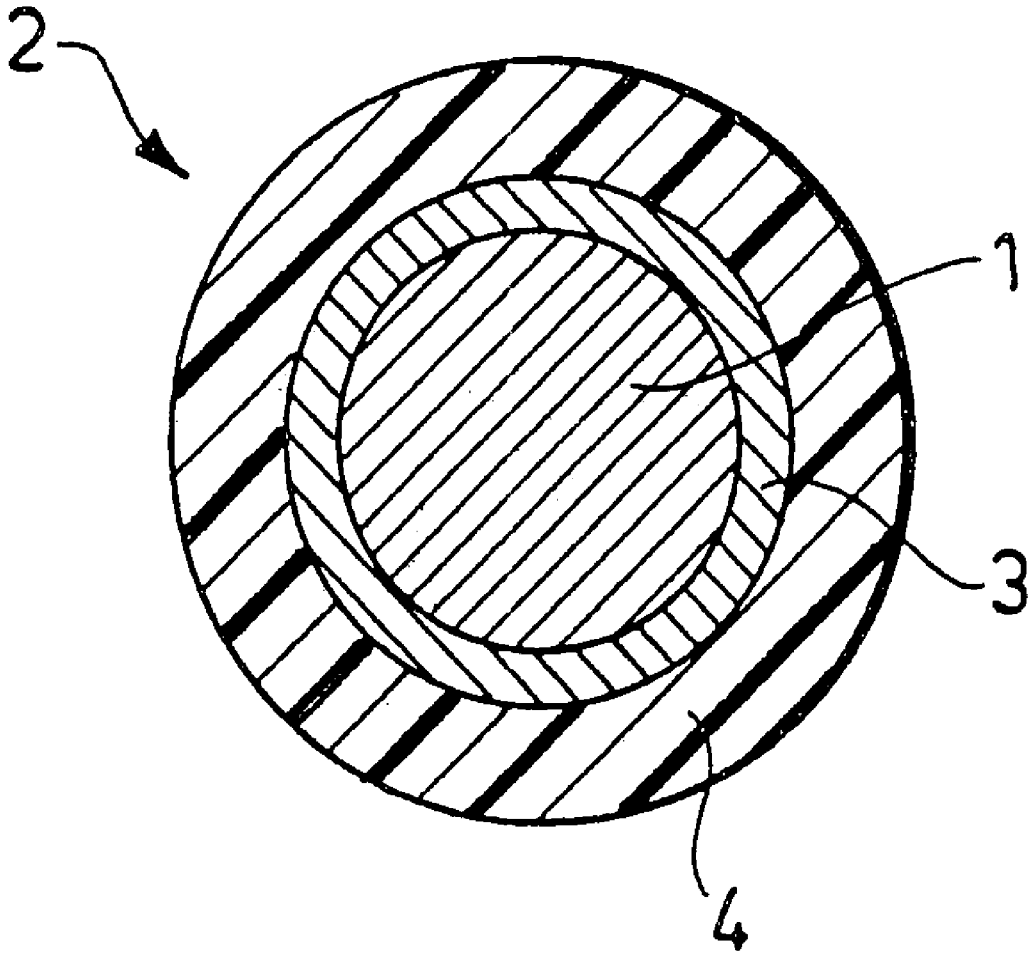
2
1
3
4

ELECTRICAL HEATING APPARATUS

FIELD OF THE INVENTION

The invention concerns an electrical heating apparatus including at least one heating body having a chemically substantially resistant sheathing enclosing same, and also a chemically substantially resistant sheathing for a heat-transmitting element such as for a heating apparatus.

BACKGROUND OF THE INVENTION

Electrical heating apparatuses comprising at least one heating body having a chemically resistant sheathing disposed around it are frequently employed in particular for use in aggressive fluid media, the sheathing being formed on the basis of fluorocarbon resin material. A heating body which is covered in that way such as a tubular heating body, a heating cable, a heating bar and the like permit only a relatively low level of loading in relation to surface area (in W per $cm^2$) as otherwise they would burn or melt down. The reason for this is the relatively poor dissipation of heat, which in the event of an excessively high level of loading results in overheating or an accumulation of heat in the heating body.

In order to improve heat dissipation, it is possible for materials which are good thermal conductors such as for example carbon or graphite or other conductive pigments to be added to the sheathing. Such additives however involve serious disadvantages, for example on the one hand they are electrically conductive. Furthermore, another consequence of such additives is that, depending on the plastic material used, the sheathing can be welded only poorly and with difficulty, or not at all. Furthermore, such an additive has the consequence that higher permeation and diffusion values occur, as a result of the foreign components contained in the material. Yet a further disadvantage of such additives is that the chemical resistance of the sheathing is substantially reduced thereby.

An attempt is made to resolve the problem of low chemical resistance of a plastic material layer with particles included therein, in DE 38 36 387 C1, insofar as only fillers which are good conductors of heat and which at the same time are resistant in relation to the aggressive fluid media are added. The use of ceramic substances such as for example silicone carbide is suggested in that respect as an additive substance. It will be noted however that this gain in terms of chemical resistance is achieved only at the expense of a severely limited choice of material for the particles which can be used. That structure also still suffers from the above-indicated disadvantages of poor weldability, poor permeation and diffusion values and sheathing porosity.

Consideration may be given to German Utility Model No. 70 24 328 describing a heating body for heating galvanic baths. In that case, the tubular heating body which is bent into a U-shape involves a shell-type structure in which an electrical resistance means or heating coil is embedded in a metal tube by means of a filling consisting of magnesium oxide. To provide protection from acid attack, the metal tube is surrounded by a plastic sheathing. In accordance with a particular configuration in that case, a further metal tube can be disposed between the first-mentioned metal tube and the plastic sheathing. The purpose of the second metal tube is to remove any thermal nodes or accumulations which may possibly occur, by the heat being dissipated in the axial direction of the metal tube. The highly different thermal conductivities as between the metal and the plastic material however mean that a severe temperature jump occurs unchanged between the second metal tube and the plastic sheathing.

DE 196 51 733 A1 discloses heatable rubber bodies which are used as sealing elements at various locations in a motor vehicle. In that case the rubber body comprises two-layer regions which are produced by co-extrusion and which, in addition to the normal rubber, include a region which is adapted to be electrically conductive by virtue of the addition of a conductive substance. However the problem of making a heating apparatus resistant to the attack of aggressive fluids is not addressed here. Furthermore, the levels of heating power and temperatures which occur are low as this only involves thawing doors, windows and the like which are frozen shut.

DE 78 34 800 U1 concerns an electrical heating element having a protective conductor, which involves a coaxial structure consisting of a heating wire and surrounding grounding. To produce the necessary electrical insulation, a plastic sheath has to be disposed in that arrangement between the heating wire and the grounding. To protect the heating element when used in aggressive fluids, the entire heating apparatus is further enclosed by an external plastic sheath which is of a known single-layer homogeneous structure.

SUMMARY OF THE INVENTION

An object of the present invention is to overcome the above-indicated disadvantages of prior electrical heating apparatuses.

Another object of the present invention is to improve an electrical heating apparatus in such a way that the heating power output thereof can be increased without detrimental consequences.

Still a further object of the present invention is to provide an electrical heating apparatus which enjoys satisfactory chemical resistance and improved heat dissipation to enhance the heating efficiency of the apparatus.

Yet a further object of the present invention is to provide a chemically substantially resistant sheathing for a heat-transmitting element, for example for an electrical heating apparatus, which while being a simple structure affords effective results in terms of chemical resistance and heat output.

In accordance with the principles of the present invention the foregoing and other objects are attained by an electrical heating apparatus having at least one heating body with a chemically substantially resistance sheathing enclosing same. The sheathing comprises an at least two-layer co-extruded material having an inner layer which in the position of use is towards the heating body and which comprises a material that is a good thermal conductor. Disposed around the inner layer is an outer layer which is thus remote from the heating body and which comprises a chemically substantially resistant, electrically non-conductive material. The inner layer and the outer layer are homogeneously fused together without air inclusions.

In the aspect of the invention relating to the chemically substantially resistant sheathing for a heat-transmitting element, in particular for an electrical heating apparatus, the sheathing comprises a co-extruded material having at least a first and a second layer, being an inner layer which is towards the heating body and which comprises a material that is a good thermal conductor. Around the inner layer is an outer layer comprising a chemically substantially resistant material which is electrically non-conductive. The inner and outer layers are homogeneously fused together without air inclusions.

As will be seen in greater detail from the description herein-after of a preferred embodiment of the invention the co-extruded material involves tubes or sheets or films which involve a kind of sandwich structure or a double or multiple composite configuration.

Due to the presence of a heat-dissipating inner layer in the sheathing the heat at the surface of the heating body can be reduced by of the order of magnitude of between 40 and 50% as the heat can be dissipated more quickly and to an improved degree thereby. The outer layer comprises natural material and provides both for good chemical resistance and also sound weldability for the sheathing. The outer layer is moreover also electrically non-conductive. There are no air inclusions between the inner and outer layers as the layers are homogeneously fused together.

The invention can provide the advantage that the loading in relation to surface area of the heating body can be raised from a previous value of about 2 $W/cm^2$ to 3 $W/cm^2$ and more in order to achieve viable, safe temperatures at the sheathing. The heating power output can be increased by between about 40 and 50% by virtue of the configuration according to the invention with the same surface area in comparison with the prior devices discussed above. That means that it is possible to enhance the effectiveness of the electrical heating apparatus by about 50%, while involving almost unchanged manufacturing costs.

In accordance with a preferred feature of the invention the inner layer may have a proportion of carbon and/or graphite and/or at least one other conductive pigment, to achieve the desired good thermal conduction effect.

In a further preferred feature of the invention the outer layer has a chemically resistant natural material which permits sound weldability.

The basic material of both the inner layer and the outer layer preferably comprises a fluorocarbon or fluoroplastic compound. Preferably, both the inner layer and the outer layer involve a material based on PFA (perfluoroalkoxy). It is however also possible to adopt materials based on FEP (fluoroethylene propylene) and/or ECTFE (ethylene chlorotrifluoroethylene) and/or PVDF (polyvinylidene fluoride), thus for example in the combination PFA/PFA or PFA/FEP or FEP/FEP or ECTFE/PVDF or ECTFE/ECTFE, the first-mentioned material in each case representing the material of the inner layer and the second material representing that of the outer layer.

A further preferred feature of the invention can also provide that the inner layer of the sheathing is connected to the outside of the heating body in a co-extrusion process without air inclusions. The fact that the sheathing is extruded directly on to the preferably metal tubular heating body provides that the formation of air inclusions between the outside of the tubular heating body and the inside of the sheathing can be at least substantially prevented. The sheathing itself can be formed for example as a foil or film with turns, in the form of a tube, in the form of a shrink tube, or in the form of layers which are directly extruded in place.

It will be noted that the above-discussed features of the invention which have been related to the electrical heating apparatus with the chemically resistant sheathing on the at least one heating body thereof also apply in relation to the aspect of the invention relating to the chemically substantially resistant sheathing for a heat-transmitting element. It will be further noted that the heat-transmitting element can be used in particular in relation to an electrical heating apparatus, as indicated hereinbefore, but also a cooling apparatus, a heat exchanger and the like.

Further objects, features and advantages of the invention will be apparent from the following description of a preferred embodiment thereof.

BRIEF DESCRIPTION OF THE DRAWING

The accompanying single FIGURE is a diagrammatic view in cross-section of an electrical heating apparatus.

DETAILED DESCRIPTION OF THE PREFERRED EMBODIMENT

Referring now to the single FIGURE of the drawing, shown therein is an electrical heating apparatus including at least one heating body in the form of a tubular heating body generally indicated at reference numeral 1. The heating body 1 has a sheathing 2 enclosing the heating body, for providing chemical resistance for same. The sheathing comprises at least two layers, more specifically an inner layer 3 and an outer layer 4. The inner layer 3 and the outer layer 4 are produced by a co-extrusion process on the heating body 1, whereby the inner layer in the position of use is towards the heating body and comprises a material that is a good thermal conductor. The outer layer 4 which is around the inner layer 3 and thus remote from the heating body 1 comprises a chemically substantially resistant, electrically non-conductive material. The inner layer 3 and the outer layer 4 are homogeneously fused together at least substantially without air inclusions.

Both the inner layer 3 and the outer layer 4 in this embodiment are each in the form of a respective tubular configuration of PFA (perfluoroalkoxy). The inner layer 3 has inclusion components consisting of carbon and/or graphite and/or at least one conductive pigment, and is thereby made into a good thermal conductor. The outer layer comprises chemically substantially resistant, electrically non-conductive material such as a chemically resistant natural material, preferably affording sound weldability.

It will be appreciated that the illustrated structure may also constitute a heat-transmitting element including a chemically substantially resistant sheathing thereon, of the same structure as described above.

It will be appreciated that the above-described embodiment of the invention has been set forth solely by way of example and illustration of the principles of the invention and that various modifications and alterations may be made therein without thereby departing from the spirit and scope of the invention.

What is claimed is:

1. An electrical heating apparatus including at least one heating body, and a chemically substantially resistant sheathing enclosing the heating body, the sheathing comprising an at least two-layer co-extruded material having an inner layer which in the position of use is towards the heating body, which comprises a material that is a good thermal conductor and which has a proportion of carbon, and an outer layer which is remote from the heating body and which comprises a chemically substantially resistant, electrically non-conductive material, wherein the inner layer and the outer layer are homogeneously fused together without air inclusions.

2. An electrical heating apparatus including at least one heating body, and a chemically substantially resistant sheathing enclosing the heating body, the sheathing comprising an at least two-layer co-extruded material having an inner layer which in the position of use is towards the heating body, which comprises a material that is a good thermal conductor and which has a proportion of conductive pigment, and an outer layer which is remote from the heating body and which comprises a chemically substantially resistant, electrically non-conductive material, wherein the inner layer and the outer layer are homogeneously fused together without air inclusions.

3. An electrical heating apparatus including at least one heating body, and a chemically substantially resistant sheathing enclosing the heating body, the sheathing comprising an at least two-layer co-extruded material having an inner layer which in the position of use is towards the heating body, which comprises a material that is a good thermal conductor and which is based on perfluoroalkoxy, and an outer layer which is remote from the heating body, which comprises a chemically substantially resistant, electrically non-conductive material and which is based on perfluoroalkoxy, wherein the inner layer and the outer layer are homogeneously fused together without air inclusions.

4. An electrical heating apparatus including at least one heating body, and a chemically substantially resistant sheathing enclosing the heating body, the sheathing comprising an at least two-layer co-extruded material having an inner layer which in the position of use is towards the heating body and is connected to the outside of the heating body in a co-extrusion process without air inclusions and which comprises a material that is a good thermal conductor, and an outer layer which is remote from the heating body and which comprises a chemically substantially resistant, electrically non-conductive material, wherein the inner layer and the outer layer are homogeneously fused together without air inclusions.

5. A chemically substantially resistant sheathing in combination with a heat-transmitting element, wherein the sheathing comprises an at least two-layer co-extruded material having an inner layer which in the position of use is towards the heat-transmitting element and which comprises a material that is a good thermal conductor, and an outer layer which is remote from the heat-transmitting element and which comprises a chemically substantially resistant, electrically non-conductive material, wherein the inner layer and the outer layer are homogeneously fused together without air inclusions.

6. An electrical heating apparatus as set forth in claim 5 wherein the inner layer has a proportion of carbon.

7. An electrical heating apparatus as set forth in claim 5 wherein the inner layer has a proportion of graphite.

8. An electrical heating apparatus as set forth in claim 5 wherein the inner layer has a proportion of conductive pigment.

9. An electrical heating apparatus as set forth in claim 5 wherein the outer layer has a chemically resistant natural material that is capable of being welded.

10. An electrical heating apparatus as set forth in claim 5 wherein the material of both the inner layer and the outer layer is based on perfluoroalkoxy.

* * * * *